US007207400B2

(12) United States Patent
Bise et al.

(10) Patent No.: US 7,207,400 B2
(45) Date of Patent: Apr. 24, 2007

(54) COUPLER AND ROOF DRILL BIT ASSEMBLY USING SUCH COUPLER

(75) Inventors: Douglas E. Bise, Chilhowie, VA (US); Joseph C. Boggs, Bristol, VA (US)

(73) Assignee: Kennametal Inc., Latrobe, PA (US)

( * ) Notice: Subject to any disclaimer, the term of this patent is extended or adjusted under 35 U.S.C. 154(b) by 257 days.

(21) Appl. No.: 10/819,672

(22) Filed: Apr. 7, 2004

(65) Prior Publication Data

US 2005/0224259 A1 Oct. 13, 2005

(51) Int. Cl.
*E21B 17/00* (2006.01)

(52) U.S. Cl. ..... 175/320; 403/383

(58) Field of Classification Search ..... 175/320, 175/415; 166/242.6; 403/383
See application file for complete search history.

(56) References Cited

U.S. PATENT DOCUMENTS

| | | | | |
|---|---|---|---|---|
| 3,554,306 | A | 1/1971 | Wilburn | |
| 4,175,757 | A | 11/1979 | Emmerich | |
| 4,206,821 | A | 6/1980 | Emmerich | |
| 4,454,922 | A * | 6/1984 | Jamison et al. | 175/323 |
| 4,615,402 | A | 10/1986 | Eisenloeffel | |
| 4,632,195 | A | 12/1986 | Emmerich | |
| 4,907,660 | A | 3/1990 | Staggs et al. | |
| 5,020,780 | A * | 6/1991 | Woodings | 266/271 |
| 5,400,861 | A | 3/1995 | Sheirer | |
| 5,833,017 | A | 11/1998 | Woods et al. | |
| 5,927,411 | A | 7/1999 | Sheirer | |
| 6,189,632 | B1 | 2/2001 | Warden | |
| 6,367,567 | B1 | 4/2002 | Massa et al. | |
| 6,516,904 | B1 | 2/2003 | Rein, Sr. et al. | |
| 6,533,049 | B1 | 3/2003 | Rein, Sr. et al. | |
| 6,598,688 | B2 | 7/2003 | Wang | |
| 2003/0051920 | A1 * | 3/2003 | Bise et al. | 175/320 |
| 2004/0016573 | A1 * | 1/2004 | Rein et al. | 175/320 |
| 2004/0238223 | A1 * | 12/2004 | Brady | 175/320 |

OTHER PUBLICATIONS

Kennametal Catalog B00-023(10)J0—entitled "Cutting and Drilling Systems" (2000) (84 pages).

* cited by examiner

*Primary Examiner*—William Neuder
(74) *Attorney, Agent, or Firm*—Matthew W. Smith

(57) ABSTRACT

A coupler for use in connecting together in a driving relationship a first member and a second member in a drill bit assembly. The coupler includes an elongate body that has opposite axial forward and rearward ends as well as contains a longitudinal bore. The elongate body further has a mediate collar wherein there is a forward body portion axial forward of the collar and a rearward body portion axial rearward of the collar. The forward body portion is suitable to drivingly engage the first member. The rearward body portion is suitable to drivingly engage the second member. Each one of the forward and rearward body portions carries seal. The elongate body further carries a retention member.

9 Claims, 3 Drawing Sheets

COUPLER AND ROOF DRILL BIT ASSEMBLY USING SUCH COUPLER

BACKGROUND OF THE INVENTION

The invention pertains to a coupler for use in connecting together in a driving relationship a first member and a second member in a rotatable cutter assembly such as, for example, a roof drill bit assembly. More specifically, the invention pertains to a wet coupler for use in connecting together in a driving relationship two members in a rotatable cutter assembly such as, for example, a roof drill bit assembly, wherein these members are, for example, either two consecutive drill steels or a chuck and a drill steel.

Expansion of an underground mine such as, for example, a coal mine, requires digging a tunnel. Initially this tunnel has an unsupported roof. In order to support and stabilize the roof in an established area in an underground tunnel, bore holes are drilled in the roof. The apparatus used to drill these holes comprises a drill with a long shaft, i.e., drill steel, attached to a drill bit. U.S. Pat. No. 6,533,049 to Rein, Sr., et al. and U.S. Pat. No. 6,598,688 to Wang each show a drill steel that is useful in a roof drill bit assembly for drilling such bore holes. U.S. Pat. No. 3,554,306 to Wilburn shows a drill rod assembly that is useful for drilling roof bolt bore holes.

A roof drill bit is detachably mounted, either directly or through the use of a chuck, to the drill steel at the distal end thereof. U.S. Pat. No. 5,927,411 to Sheirer and U.S. Pat. No. 5,833,017 to Woods et al. each show a roof drill bit assembly. To commence the drilling operation, the roof drill bit is then pressed against the roof and the drilling apparatus is operated so as to drill a bore hole in the roof. The bore holes extend between two feet to greater than twenty feet into the roof. These bore holes are filled with resin and roof bolts are affixed within the bore holes. A roof support, such as roof panels, is then attached to the roof bolts.

In the past, one basic method of drilling these roof bolt bore holes has been a wet drilling method, i.e., a method where a coolant passes through the roof drill bit assembly and then impinges upon the cutting inserts and in the area of drilling through fluid passages contained in the forward and of the roof drill bit. U.S. Pat. No. 5,400,861 to Sheirer shows one example of a roof drill bit assembly that can be useful in wet drilling.

In a roof bolt hole drilling operation, it is important that the cutting inserts of the roof drill bit receive sufficient coolant, which is typically water, to maintain a sufficiently low temperature. Because drilling generates great amounts of heat, it is necessary to cool the drill bit to avoid, or at least to reduce, the thermal degradation of the cutting insert material. This is true for most cutting insert materials including without limitation polycrystalline diamond composite and cemented tungsten carbide-cobalt materials. It is thus important in a wet drilling operation for a roof drill bit assembly to deliver sufficient coolant to the cutting insert in an efficient fashion.

In the wet drilling assembly, the connections between the chuck and the roof bit along the roof drill bit assembly provide for communication between the pressurized coolant and the outside of the roof bit. During the drilling operation, it is not unusual for coolant to escape through these connections. Because the roof drill bit rotates at a high rate of revolution and the coolant is under pressure, the coolant that escapes typically does so in a high pressure stream so as to spray the operator with coolant. This makes the operator uncomfortable and makes for an unpleasant working environment. Such high pressure loss also reduces the volume of coolant which the roof drill bit assembly delivers to the cutting inserts thereby reducing the efficiency of the roof drill bit assembly.

It is therefore desirable to provide an improved wet coupler for use in connecting together in a driving relationship two members in a roof drill bit assembly wherein there is a good fluid-tight seal between the wet coupler and the driven members. By providing such a good fluid-tight seal, there is less of a chance that coolant will escape through the connections between the coupler and the driven members, and hence, more coolant will be transported to the roof drill bit.

In a wet drilling operation, it is typical that the exposed surfaces of the components suffer wear through erosion. This is the case for the exterior surface of a drill steel wherein such exterior surface suffers such erosion and wear to an extent greater than in a vacuum drilling operation. It is not unusual for a coupler to provide the connection between drills steels (or a drill steel and a chuck) whereby the exterior surface of the drill steel is useful to provide the driving connection. Because of the fact that the exterior surface the drill steel suffers more erosion and wear, the integrity of the driving connection provided by such a coupler typically diminishes along with the integrity of the exterior surface of the drill steel. A reduction in the integrity of the connection provided by the coupler reduces the efficiency of the drilling operation.

Thus, it would be desirable to provide an improved wet coupler for use in connecting together in a driving relationship two members in a roof drill bit assembly wherein the connection between the coupler and the members maintains its integrity during the drilling operation, and especially in a wet drilling operation.

SUMMARY OF THE INVENTION

In one form thereof, the invention is a coupler for use in connecting together in a driving relationship a first member and a second member in a rotatable cutter assembly. The coupler includes an elongate body that has an axial forward end and an axial rearward end. The elongate body contains a longitudinal bore. The elongate body further includes a mediate collar. A forward body portion of the elongate body is axial forward of the collar whereby the forward body portion is suitable to drivingly engage the first member. A rearward body member of the elongate body is axial rearward of the collar whereby the rearward body portion is suitable to drivingly engage the second member. A forward seal is bonded to the forward portion of the elongate body. The forward seal is spaced apart from the collar. A rearward seal is bonded to the rearward body portion of the elongate body. The rearward seal is spaced apart from the collar.

In another form thereof, the invention is a coupler-chuck-drill steel assembly. This assembly comprises a coupler that has an axial forward end and an axial rearward end. The coupler contains a longitudinal bore. The coupler further includes a mediate collar. A forward coupler portion of the coupler is axial forward of the collar. A rearward coupler portion of the coupler is axial rearward of the collar. A forward seal is bonded to the forward coupler portion. A rearward seal is bonded to the rearward coupler portion. The coupler carries a retention member. The coupler-chuck-drill steel assembly also includes a chuck that has an axial forward end and an axial rearward end. The chuck contains a longitudinal bore wherein the longitudinal bore has an axial forward bore portion and an axial rearward bore portion. The axial forward bore portion has a transverse dimension greater than the transverse dimension of the axial rearward bore portion so as to form a forward facing shoulder at the junction thereof. The axial rearward bore portion is defined by a polygonal surface. The rearward coupler portion presents a polygonal surface. The coupler is contained within the longitudinal bore of the chuck wherein the collar of the coupler abuts the forward facing shoulder so that the polygonal surface of the axial rearward portion of the coupler drivingly engages the polygonal surface of the axial rearward bore portion of the chuck. The axial forward portion of the coupler is within and spaced apart from the forward bore portion of the chuck. A drill steel is received within the axial forward bore portion of the chuck.

In yet another form thereof, the invention is a coupler-drill steel assembly. This assembly includes a first drill steel that has a central bore and an exterior surface and an interior polygonal surface wherein the first drill steel also has a distal end. The assembly further includes a second drill steel that has a central bore and an exterior surface and an interior polygonal surface wherein the second drill steel also has a distal end. The assembly includes a coupler that has an axial forward end and an axial rearward end wherein the coupler further contains a longitudinal bore. The coupler also includes a mediate collar. A forward portion of the coupler is axial forward of the collar and a rearward portion of the coupler is axial rearward of the collar. A forward seal is bonded to the forward portion of the coupler. A rearward seal is bonded to the rearward portion of the coupler. The coupler also carries a retention member. The first drill steel receives the axial forward portion of the coupler so that the distal end of the first drill steel abuts the collar and the forward coupler portion drivingly engages the interior of the first drill steel. The second drill steel receives the axial rearward portion of the coupler so that the distal end of the second drill steel abuts the collar and the rearward coupler portion drivingly engages the interior surface of the second drill steel.

BRIEF DESCRIPTION OF THE DRAWINGS

The following is a brief description of the drawings which form a part of this patent application.

DETAILED DESCRIPTION OF THE INVENTION

Figure 1:
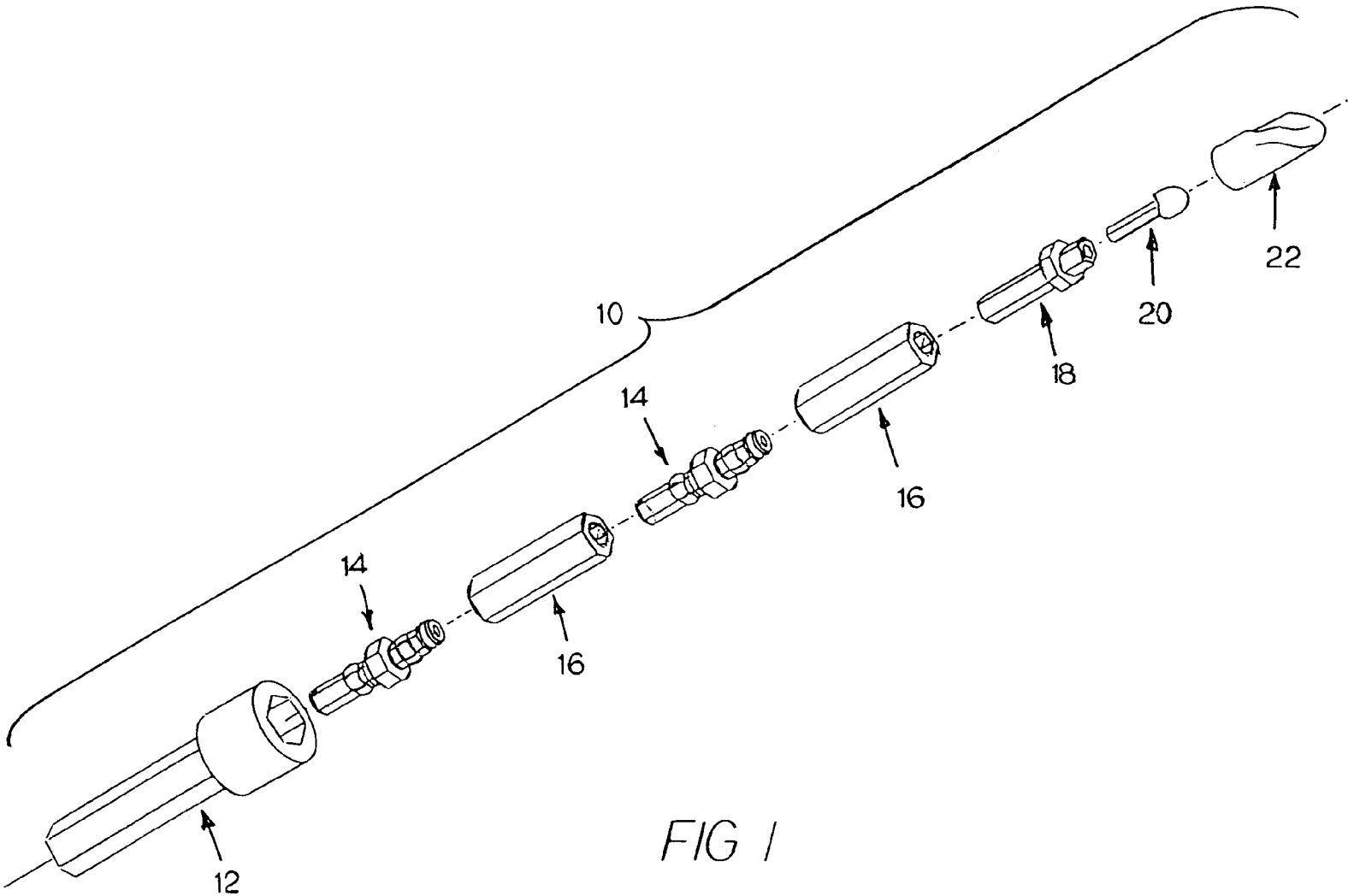
FIG. 1 is an isometric view of a roof drill bit assembly that includes, among other components, a chuck adapter, a wet coupler, a pair of drill steels, and a roof drill bit wherein the components of the assembly are exploded along a common longitudinal axis.

Referring to the drawings, FIG. 1 illustrates in an exploded view a specific embodiment of a rotatable cutter assembly (and more specifically a roof drill bit assembly) as shown by bracket 10. The roof drill bit assembly 10 includes a chuck adapter (or chuck) generally designated as 12, a pair of wet couplers each one of which is generally designated as 14, a pair of drill steels each one of which is generally designated as 16, a coupler generally designated as 18, an adapter generally designated as 20 and a roof drill bit generally designated as 22. The components of the roof drill bit assembly 10 are exploded along a common longitudinal axis for sake of clarity. However, it should be appreciated that for the purpose of operation, these components would be assembled together to form an assembled roof drill bit assembly.

Coupler 18 is a conventional component such as, for example, a 5414 vacuum chuck (SAP #1012082), sold by Kennametal Inc. of Latrobe, Pa. 15650 USA. Adapter 20 is also a conventional component such as, for example, a KWH1 wet seal (SAP #1895511), sold by Kennametal Inc. of Latrobe, Pa. 15650 USA.

Figure 3:
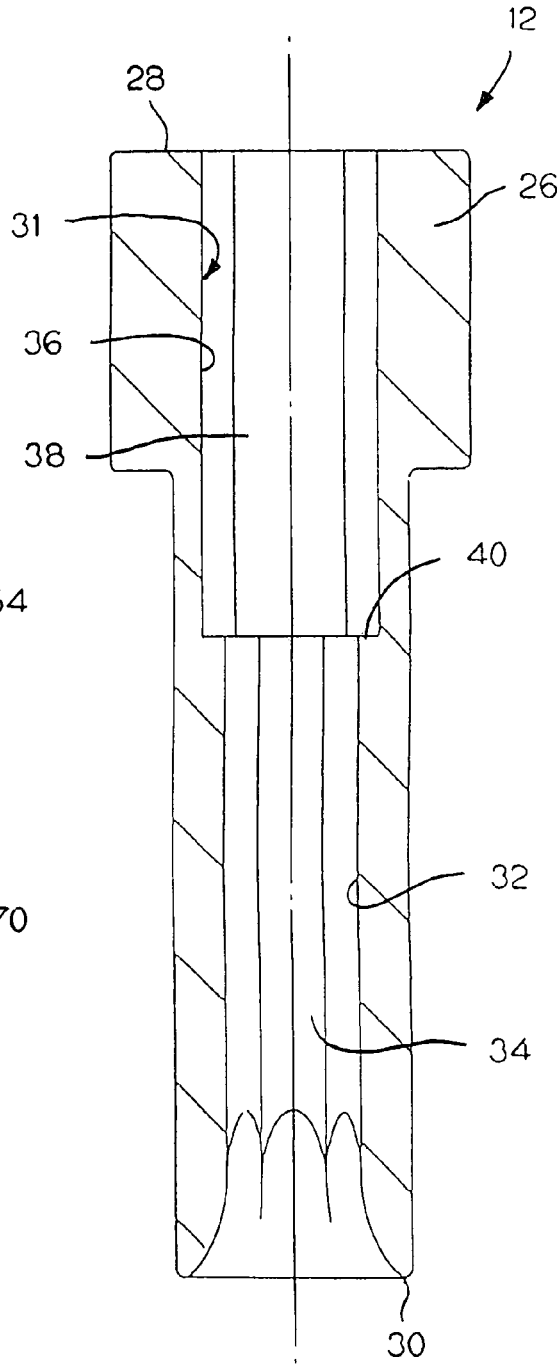
FIG. 3 is a cross-sectional side view of the chuck as shown in FIG. 1.

Referring to FIG. 3, there is shown in cross-section the structure of the chuck adapter generally designated as 12. The chuck adapter 12 includes a chuck adapter body 26 that has an axial forward end 28 and an axial rearward end 30. The chuck adapter body 26 further includes a central longitudinal bore 31 that includes a rearward bore portion 32 which is defined by a hexagonal (i.e., polygonal) surface 34. The central longitudinal bore 31 of the chuck adapter body 26 also includes a forward bore portion 36 that is defined by a hexagonal (i.e. polygonal) surface 38.

The rearward bore portion 32 of the chuck adapter body 26 has a transverse dimension that is less than the transverse dimension of the forward bore portion 36. There is a forwardly facing shoulder 40 at the juncture between the rearward bore portion 32 and the forward bore portion 36 of the central longitudinal bore 31 of the chuck adapter body 26.

Figure 2:
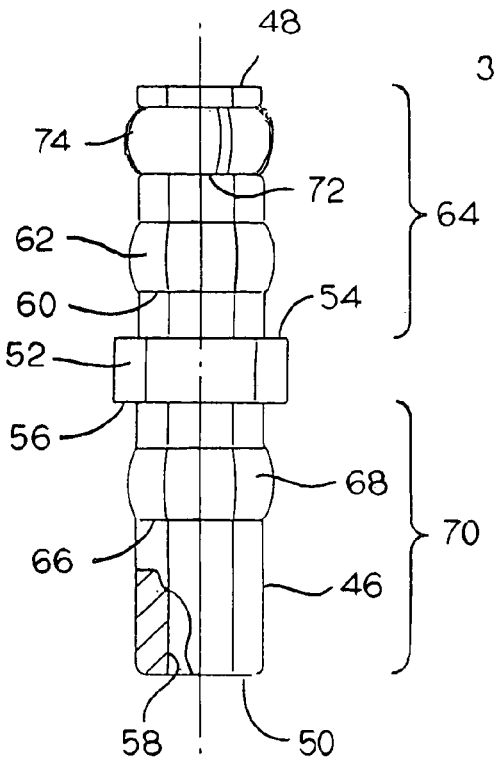
FIG. 2 is a side view of the specific embodiment of the coupler shown in FIG. 1 wherein a portion of the coupler is cut away so as to expose the central longitudinal bore thereof.

FIG. 2 illustrates the wet coupler 14 as shown in FIG. 1. Wet coupler 14 includes a wet coupler body 46 (or elongate body) that has a generally hexagonal (i.e. polygonal) geometry along the exterior surface thereof. Wet coupler body 46 includes an axial forward end 48 and an axial rearward end 50, as well as a radial mediate collar 52 that is mediate of the axial forward end 48 and the axial rearward end 50 thereof. Mediate collar 52 presents a hexagonal (i.e., polygonal) peripheral edge. Radial collar 52 presents a forward facing shoulder 54 and a rearward facing shoulder 56 wherein each shoulder (54, 56) presents a generally planar surface. Wet coupler body 46 also contains a central bore 58 that presents a generally cylindrical geometry.

The wet coupler body 46 has an axial forward coupler body portion as shown by bracket 64 that is axial forward of the mediate collar 52, as well as an axial rearward coupler body portion a shown by bracket 70 that is axial rearward of the mediate collar 52. The forward coupler body portion 64 of the wet coupler body 46 contains a forward seal groove 60 therein that is spaced apart from the mediate collar 52. The forward seal groove 60 is also spaced apart from the axial forward end 48 of the wet coupler body 46. The rearward coupler body portion 70 of the wet coupler body 46 contains a rearward seal groove 66 therein that is spaced apart from the mediate collar 52. The rearward seal groove 66 is also spaced apart from the axial rearward end 50 of the wet coupler body 46.

A forward seal 62 is mold bonded to the wet coupler body 46 at the location of the forward seal groove 60 so as to be contained in the forward seal groove 60. A rearward seal 68 is mold bonded to the wet coupler body 46 at the location of the rearward seal groove 66 so as to be contained in the rearward seal groove 66. Forward seal 62 is spaced apart from the mediate collar 50 and the axial forward end 48 of the wet coupler body 46. Rearward seal 68 is spaced apart from the mediate collar 50 and the axial rearward end 50 of the wet coupler body 46.

Each one of the forward seal 62 and rearward seal 66 is made from an elastomeric material, and more preferably, from buna nitrile rubber that has a Shore durometer hardness (as measured by the Shore test for hardness) equal to 70±5 on the Shore A hardness scale. In the mold bonding process, the wet coupler body 46 is positioned in a mold. The elastomeric material (e.g., buna nitrile rubber) from which the seals (62, 68) are made is then injected into the mold so as to form the seals (62, 68) wherein the seals are bonded to the wet coupler body 46 so as to be formed in their corresponding seal grooves (60, 66).

One exemplary material for the wet coupler body 46 is 4140 grade of steel.

Forward seal 62 and rearward seal 68 each presents an exterior surface that has a hexagonal (or polygonal) geometry that corresponds with the hexagonal geometry of the wet coupler body 46. In other words, the seals (62, 68) are oriented so that the exterior hexagonal surfaces thereof are in axial alignment with the exterior hexagonal surfaces of the wet coupler body 46. The exterior surface of each one of the seals (62, 68) projects past the exterior surface of the wet coupler body 46 so as to be effective to create a seal between the wet coupler 14 and either the chuck adapter 12 or the drill steels(s) 16 as will be discussed hereinafter.

The forward coupler body portion 64 of the wet coupler body 46 contains a retainer groove 72 that carries a resilient split retainer ring (or retention member) 74. Resilient spilt ring retainer 74 has a generally cylindrical exterior surface. The retainer groove 72 is spaced part from, but is still adjacent to, the axial forward end 48 of the wet coupler body 46.

Each one of the drill steels 16 includes an elongate drill steel body 78 that has a generally hexagonally shaped exterior surface 80. Drill steel body 78 further includes an axial forward end 82 and an axial rearward end 84. Drill steel body 78 also contains a central longitudinal bore 86 that is defined by an interior hexagonal (i.e., polygonal) surface 88.

Figure 4:
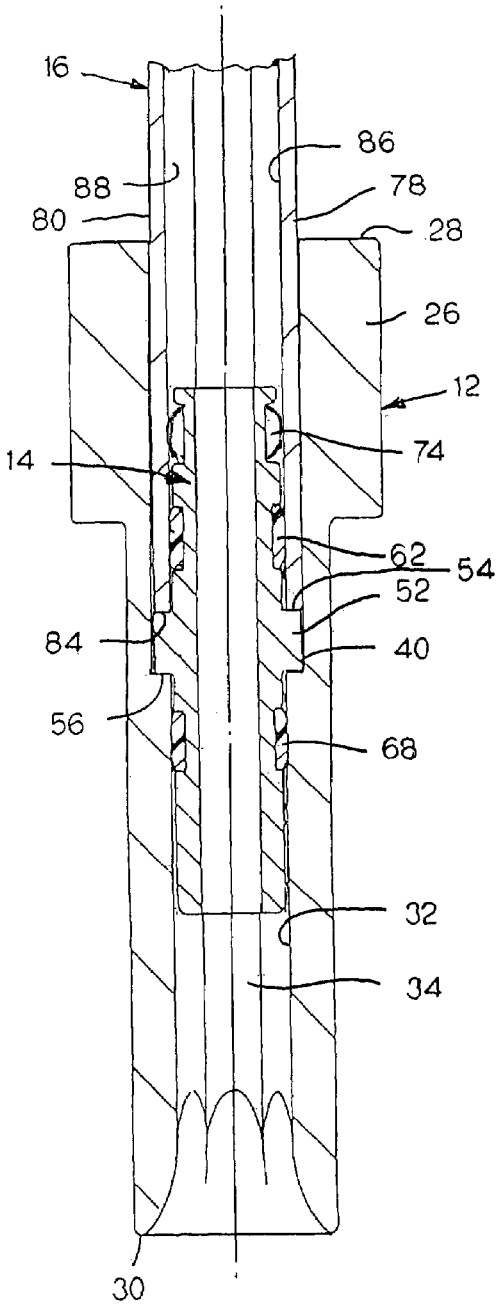
FIG. 4 is a cross-sectional side view of the assembly of the chuck and the coupler and the drill steel as shown in FIG. 1.

FIG. 4 illustrates the driving connection provided through the wet coupler 14 between the chuck adapter 12 and one of the drill steels 16. FIG. 4 also illustrates the seal that the wet coupler 14 creates between itself and the chuck adapter 12, as well as the seal that the wet coupler 14 creates between itself and the drill steel 16.

Although it will become apparent from the description of the connection below, the driving connections between the wet coupler 14 and each one of the drill steel 16 and the chuck adapter 12 use the interior surfaces of drill steel 16 and the chuck adapter 12. By doing so, the integrity of the driving connection is better maintained, especially in a wet drilling operation, than if the exterior surface of either the chuck adapter or the drill steel was used to provide the driving connection through the wet coupler. As will also become apparent, the forward seal 62 and the reward seal 68 are each spaced apart from locations on the wet coupler 14 that are at or near the juncture of the adjacent components of the drilling assembly. As a result, the seals (62, 68) are not subjected to the operational thrust forces that exist at or near these junctures of the adjacent components of the drilling assembly. Heretofore, a seal that has been located near these junctures can have significant trust forces exerted thereon that can result in the destruction or deformation of the seal so as to compromise the integrity of the fluid-tight seal.

In regard to the connection, the wet coupler 14 is contained within the central bore of the chuck adapter body 26 in such a fashion that the rearward facing shoulder 56 of collar 52 on wet coupler body 46 abuts against the forward facing shoulder 40 of chuck adapter body 26. It can thus be seen that the forward coupler body portion 64 is contained within the forward bore 36 of the chuck adapter 12. It can also be seen that the rearward coupler body portion 70 is contained within the rearward bore 32 of the chuck adapter 12.

The hexagonal exterior surface of the rearward seal 68 seals against the hexagonal surface 34 of the rearward chuck bore 32 so as to create a fluid-tight seal between the rearward coupler body portion 70 of the wet coupler 14 and the rearward chuck bore 32 of the chuck adapter 12. As mentioned above, the rearward seal 68 is positioned away from the point of the junction (or abutment) between the wet coupler 14 and the chuck adapter 12 so as to not encounter thrust forces that exist at such junction.

It can also be seen that prior to the insertion of the drill steel 16 into the forward bore 36 of the chuck adapter body 26, the forward coupler body portion 64 of the wet coupler 14 is spaced apart (i.e., radially or transversely inward spaced apart) from the hexagonal surface 38 that defines the forward chuck bore 36 of the chuck adapter 12. As shown in FIG. 4, in order to drivingly connect the drill steel 16 to the chuck adapter 12 via the wet coupler 14, the drill steel 16 is inserted into the forward bore 36 of the chuck adapter 12. When fully inserted into the chuck adapter 12, the drill steel 16 has an axial rearward end (or distal end) 84 that seals against the forward facing shoulder 54 of collar 52 of the wet coupler 14. The hexagonal surface of the forward seal 62 carried by the wet coupler 14 abuts against the interior hexagonal surface 88 of the drill steel so as to create a fluid-tight seal between the drill steel and the forward coupler body portion 64 of the wet coupler 14. As mentioned above, forward seal 62 is positioned away from the junction (or point of abutment) between the wet coupler 14 and the drill steel 16 so as to not encounter thrust forces that exist at such junction.

Furthermore, the resilient retainer ring 74 engages the hexagonal surface 88 of the drill steel 16 so as to retain the wet coupler 14 within the central bore 86 of the drill steel 16.

As can be appreciated, there is a driving connection between the wet coupler 14 and the drill steel 16 as well as a driving connection between the wet coupler 14 and the chuck adapter 12. It should be appreciated that the surface of engagement to create this driving connection is the interior hexagonal surface 88 of the drill steel 16, as well as the interior surface of the chuck adapter 12. The interior surface 88 of the drill steel 16 is less subject to erosion and wear than is the exterior surface thereof, especially in a wet drilling environment. The connection between the wet coupler 14 and the drill steel 16 thus maintains its integrity even though the exterior surface of the drill steel 16 may experience erosion and wear.

It should also be appreciated from the above discussion that the locations of the forward seal 62 and the rearward seal 68 are such so that these seals do not encounter thrust forces that exist at the locations where the wet coupler 14 abuts the drill steel 16 and the chuck 12, respectively. The useful life of these seals (62, 68) and the integrity of the fluid-tight seals created thereby are thus prolonged because these seals do not encounter such thrust forces.

Figure 5:
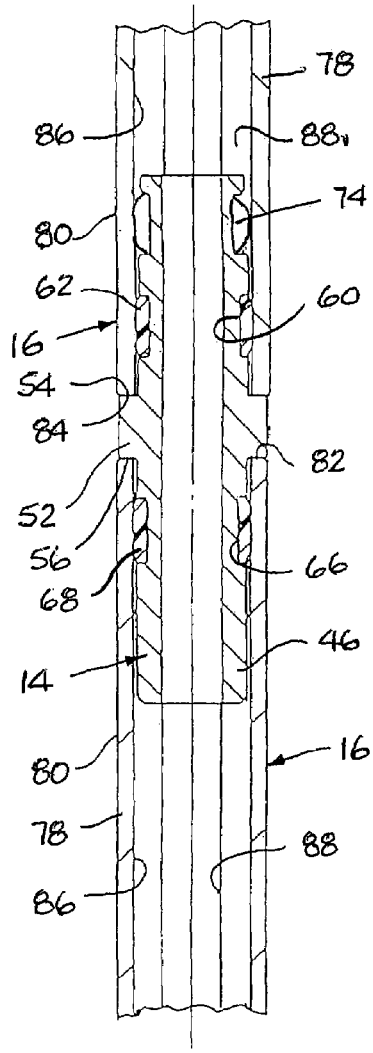
FIG. 5 is a cross-sectional side view showing the assembly of a coupler and the first drill steel and the second drill steel as shown in FIG. 1.

Referring to FIG. 5, there is shown in cross-section the connection between the wet coupler 14 and a first drill steel 16 and a second drill steel 16. For the sake of convenience, although these drill steels 16 are separate components of the roof drill bit assembly, they are structurally the same, and hence, are identified by the same reference numerals. Even though it will become apparent from the description of the connection below, the driving connections between the wet coupler 14 and each one of the drill steels 16 use the interior surfaces of drill steels 16 to establish this driving connection. By doing so, the integrity of the driving connection is better maintained, especially in a wet drilling operation, than if the exterior surface of the drill steel was used to provide the driving connection. As is also apparent from the description below, the seals (62, 68) that create the fluid-tight seals between the wet coupler 14 and the drill steels 16 are spaced apart from the junctures between the wet coupler 14 and the drill steels 16 so as to not encounter the thrust forces that exist at such junctures. The useful life of these seals (62, 68) and the integrity of the fluid-tight seals created thereby are thus prolonged because these seals do not encounter such thrust forces.

In regard to this driving connection, the first (or upper as illustrated in FIG. 5) drill steel 16 has the axial rear end 84 thereof in abutment against the forward facing shoulder 54 of the collar 52 of the wet coupler 14. In this condition, the hexagonal exterior surface of the forward seal 62 seals against the interior surface of the drill steel so as to form a fluid-tight seal between the first (or upper) drill steel 16 and the forward coupler body portion 64 of the wet coupler 14. The second (or lower as illustrated in FIG. 5) drill steel 16 has an axial forward end 82 which abuts against the rearward facing shoulder 56 of collar 52 of wet coupler 14. In this condition, the hexagonal exterior surface of the rearward seal 68 seals against the interior surface of the drill steel so as to form a fluid-tight seal between so as to form a fluid-tight seal between the rearward coupler body portion 70 of wet coupler 14 and the interior surface 88 of the lower drill steel 16.

The resilient retainer 74 engages the interior surface 88 of the upper drill steel 16 so as to retain the wet coupler 14 to the upper drill steel 16.

Referring to the overall roof drill bit assembly 10, it should be appreciated that when the components are connected together, there is an essentially unobstructed fluid passageway from the rearward end of the assembly (and a source of coolant) to the roof drill bit where the coolant exits the roof drill bit assembly. The roof drill bit assembly may also be used in vacuum drilling, as well as in wet drilling. However, in vacuum drilling it may be necessary to use roof drill bits that are different from those used in wet drilling.

When in the assembled condition, there is a registration between the hexagonal exterior surfaces of the wet coupler 14 and the hexagonal interior surface 88 of both the upper drill steel 16 and the lower drill steel 16. The location of engagement that establishes this driving connection is with the interior hexagonal surface 88 of the drill steel 16. The interior hexagonal surface 88 does not experience erosion and wear to the same degree, especially in wet drilling, as does the exterior surface of drill steel 16. Hence, by using the interior surfaces of the drill steels to establish the driving connections, the integrity of these driving connections is better than if the driving connections were established at the exterior surfaces of the drill steels.

Also when in the assembly condition and as mentioned above, the seals (62, 68) are not near a juncture (or a point of abutment) between the wet coupler 14 and the drill steels 16. As a result, the seals are not subjected to (or do not encounter) thrust forces that could damage or destroy the seals so as to compromise the integrity of the fluid-tight seal.

Overall, it can be appreciated that the present invention provides a number of advantages. In this regard, the use by the wet coupler of the interior surfaces of the drill steels, as well as the interior surface of the chuck, to establish the driving connection enhances the integrity of the driving connection, especially in wet drilling conditions. Further, the presence of fluid-tight seals provided by the wet coupler 14 reduces the amount of coolant that sprays out of the roof drill bit assembly. This enhances the comfort and convenience of the working environment for the operator. In addition, the positioning of the seals so as to be spaced apart from the junction between the wet coupler and either the drill steels(s) or the chuck allow the seals to not encounter thrust forces, and thus, prolong the useful life of the seals.

The patents and other documents identified herein are hereby incorporated by reference herein. Other embodiments of the invention will be apparent to those skilled in the art from a consideration of the specification or a practice of the invention disclosed herein. It is intended that the specification and examples are illustrative only and are not intended to be limiting on the scope of the invention. The true scope and spirit of the invention is indicated by the following claims.

What is claimed is:

1. A coupler for use in connecting together in a driving relationship a first member and a second member in a rotatable cutter assembly, the coupler comprising:

an elongate body having an axial forward end and an axial rearward end, and the elongate body containing a longitudinal bore;

the elongate body further including a mediate collar, a forward body portion of the elongate body being axial forward of the collar whereby the forward body portion is suitable to drivingly engage the first member and a rearward body portion of the elongate body being axial rearward of the collar whereby the rearward body portion is suitable to drivingly engage the second member;

a forward seal bonded to the forward body portion of the elongate body, the forward seal being spaced apart from the collar, and the forward seal creating a continuous fluid-tight seal between the coupler and the first member when the coupler drivingly engages the first member; and a rearward seal bonded to the rearward body portion of the elongate body, the rearward seal being spaced apart from the collar, and the rearward seal creating a continuous fluid-tight seal between the coupler and the second member when the coupler drivingly engages the second member.

2. The coupler of claim 1 wherein the elongate body presents an exterior surface that is polygonal.

3. The coupler of claim 1 wherein the forward seal is spaced apart from the axial forward end of the elongate body, and rearward seal is spaced apart from the axial rearward end of the elongate body.

4. The coupler of claim 1 wherein the forward body portion of the elongate body contains a forward groove that has the forward seal therein and the rearward body portion of the elongate body contains a rearward groove that has the rearward seal therein.

5. The coupler of claim 4 wherein the forward seal is formed in the forward groove, and the rearward seal is formed in the rearward groove.

6. The coupler of claim 1 further including a retention member, and the retention member is a resilient split ring received in a retainer groove contained in the elongate body.

7. The coupler of claim 1 wherein when the coupler connects the first member and the second member, the first member and the second member each abut against the collar.

8. The coupler of claim 1 wherein the forward seal has an exterior surface that is polygonal when the forward seal is in an uncompressed condition, and the rearward seal has an exterior surface that is polygonal when the rearward seal is in an uncompressed condition.

9. The coupler of claim 8 wherein the elongate body presents an exterior surface that is polygonal, and the forward seal and the rearward seal have an orientation so that the exterior surface of the forward seal and the exterior surface of the rearward seal are in alignment with the exterior surface of the elongate body.

* * * * *